US010501253B2

(12) United States Patent
Chen

(10) Patent No.: US 10,501,253 B2
(45) Date of Patent: Dec. 10, 2019

(54) PACKAGING BOX HAVING SEPARATION PLATES FOR PACKAGING A PLURALITY OF OBJECTS

(71) Applicant: Haoneng Chen, Guangdong (CN)

(72) Inventor: Haoneng Chen, Guangdong (CN)

( * ) Notice: Subject to any disclaimer, the term of this patent is extended or adjusted under 35 U.S.C. 154(b) by 118 days.

(21) Appl. No.: 15/328,636

(22) PCT Filed: Jan. 4, 2015

(86) PCT No.: PCT/CN2015/070034
§ 371 (c)(1),
(2) Date: Sep. 14, 2017

(87) PCT Pub. No.: WO2016/011793
PCT Pub. Date: Jan. 28, 2016

(65) Prior Publication Data

US 2018/0127184 A1 May 10, 2018

(30) Foreign Application Priority Data

Jul. 24, 2014 (CN) ..... 2014 1 0355808

(51) Int. Cl.
*B65D 81/05* (2006.01)
*B65D 25/04* (2006.01)
(Continued)

(52) U.S. Cl.
CPC ..... *B65D 81/05* (2013.01); *B65D 25/04* (2013.01); *B65D 81/075* (2013.01); *B65D 85/34* (2013.01)

(58) Field of Classification Search
CPC ..... B65D 81/075
(Continued)

(56) References Cited

U.S. PATENT DOCUMENTS 4,333,573 A * 6/1982 Holoubek ..... B42F 7/12 206/509
4,903,827 A * 2/1990 Phelps ..... B65D 81/075 206/204
(Continued)

FOREIGN PATENT DOCUMENTS

CN 104150114 A 11/2014
CN 203975588 U 12/2014
(Continued)

OTHER PUBLICATIONS

International Search Report dated Apr. 21, 2015.

*Primary Examiner* — J. Gregory Pickett
*Assistant Examiner* — Tia Cox
(74) *Attorney, Agent, or Firm* — Ryan T. Grace; Advent, LLP

(57) ABSTRACT

The present invention discloses a packaging box comprising separation plates, wherein the separation plate comprises an upper separation film, a lower separation film and a frame, the upper separation film and the lower separation film are fixed on the frame, and a pre-set distance is provided between the two films. During packaging, a fruit is packaged by snapping with the separation plates from top and bottom, or the fruit is packaged by snapping directly with the upper separation film and the lower separation film of the same separation plate from top and bottom. By packaging the fruit with the upper separation film and the lower separation film which have a certain elasticity and a tensile force, the fruit can be fixed via elastic deformation, the fruits in the same layer can be prevented from colliding against each other, and a certain distance is provided between separation plates and between the upper separation film and the lower separation film so as to form a buffer area, which prevents the fruits in
(Continued)

the upper layer and in the lower layer from colliding against each other during transportation.

9 Claims, 4 Drawing Sheets

(51) Int. Cl.
*B65D 85/34* (2006.01)
*B65D 81/07* (2006.01)

(58) Field of Classification Search
USPC ..... 206/509, 560, 583, 204, 472, 523, 589, 206/588, 557–67, 528, 591–3, 499, 516; 426/392, 106, 119, 108; 264/544; 229/2.5, 120, 29, 339; 217/26.5, 27, 40, 217/28, 26
See application file for complete search history.

(56) References Cited

U.S. PATENT DOCUMENTS

| | | | | |
|---|---|---|---|---|
| 5,386,911 | A * | 2/1995 | Payne | B65D 81/075 206/583 |
| 2005/0121354 | A1* | 6/2005 | Gillis | B65D 81/07 206/583 |
| 2013/0302489 | A1* | 11/2013 | Marlin, Jr. | B65D 5/4295 426/419 |

FOREIGN PATENT DOCUMENTS

| | | | |
|---|---|---|---|
| JP | 2000053180 | A | 2/2000 |
| JP | 2002293377 | A | 10/2002 |
| JP | 3145864 | U | 10/2008 |
| WO | 0134497 | A1 | 5/2001 |

* cited by examiner

PACKAGING BOX HAVING SEPARATION PLATES FOR PACKAGING A PLURALITY OF OBJECTS

TECHNICAL FIELD

The present invention relates to the field of packages, and specifically relates to a packaging box.

BACKGROUND

During a product transportation process, the product is often packaged to prevent damage by jolts on the way. Particularly for transportation of a juicy fruit with a small volume, a soft surface and a low resistance to crushing, such as blueberry, cherry, strawberry and waxberry, a packaging box is especially required to protect the fruit during the transportation. However, in existing packaging boxes, these small fruits are piled in a small box, or separated via a single-layer separation plate in the box; in the transportation process, the fruits are easily shook and pressed on each other to cause deformation, or even worse, the squeezed juice flows onto the other fruits, and a part or all of the fruits in the box will go bad after a period of time, which will cause a huge economic loss in mass transportation.

CONTENTS OF THE INVENTION

The present invention provides a packaging box which has a good shakeproof effect and can prevent fruits from colliding against each other.

The present invention provides a packaging box comprising separation plates comprising an elastic upper separation film, an elastic lower separation film, and a frame for supporting the upper separation film and the lower separation film, the upper separation film and the lower separation film being fixed on the frame and spaced apart from each other, and a pre-set distance is provided between the upper separation film and the lower separation film.

Further, the separation plates are stacked one above another via the frame, a cavity for fixing an object to be packaged is formed between the separation plates which are stacked one above another, and the height of the cavity is lower than that of the object to be packaged so that the upper separation film and the lower separation film fix the object to be packaged via elastic deformation.

Further, a vent for retaining freshness and a skeleton are provided on the frame, the vent is located either above the upper separation film or below the lower separation film, and the skeleton passes between the upper separation film and the lower separation film.

In other embodiments, a secondary frame is provided on the upper separation film, the upper separation film is fixed on the frame in an openable manner via the secondary frame, a cavity for fixing an object to be packaged is enclosed by the upper separation film, the lower separation film and the frame, and the height of the cavity is lower than that of the object to be packaged so that the upper separation film and the lower separation film fix the object to be packaged via elastic deformation.

Further, a vent for retaining freshness and a skeleton are provided on the frame, the vent is located between the upper separation film and the lower separation film, and the skeleton passes above the upper separation film or below the lower separation film.

Further, the longitudinal section of the frame is an upright Z-shape, and said separation plates (1) are snapped together via the Z-shaped structure of the frame (13) such that said separation plates are stacked one above another.

In other embodiments, the frame is composed of an inner frame and an outer frame which have square longitudinal sections, the inner frame and the outer frame are fixed in a staggered manner in the direction of the longitudinal section so as to form the frame of an upright Z-shaped structure.

In other embodiments, the packaging box also comprises an upper cover and a lower cover, wherein the upper cover and the lower cover are respectively fixed at an upper end and a lower end of the separation plates which are stacked one above another.

In other embodiments, the packaging box also comprises a wave-shaped buffer member, wherein the buffer member is fixed on an outer surface of the separation plates which are stacked one above another.

In other embodiments, the packaging box also comprises a box body, wherein the box body is provided with at least two cavities for accommodating the separation plates, a space for separating the separation plates is provided between the cavities, and the separation plates are fixed in the cavities of the box body like a drawer.

The beneficial effects of the present invention are: the packaging box comprises separation plates comprising an upper separation film, a lower separation film and a frame, the upper separation film and the lower separation film being fixed on the frame, and a pre-set distance being provided between the two films. During packaging, fruits are packaged by snapping with the separation plates from top and bottom, or the fruits are packaged by snapping directly with the upper separation film and the lower separation film of the same separation plate from top and bottom. By packaging the fruits with the upper separation film and the lower separation film which have a certain elasticity and a tensile force, the fruit can be fixed via elastic deformation, the fruits in the same layer can be prevented from colliding against each other, and a certain distance is provided between separation plates and between the upper separation film and the lower separation film so as to form a buffer area, which prevents the fruits in the upper layer and in the lower layer from colliding against each other during transportation.

PARTICULAR EMBODIMENTS

Figure 1:
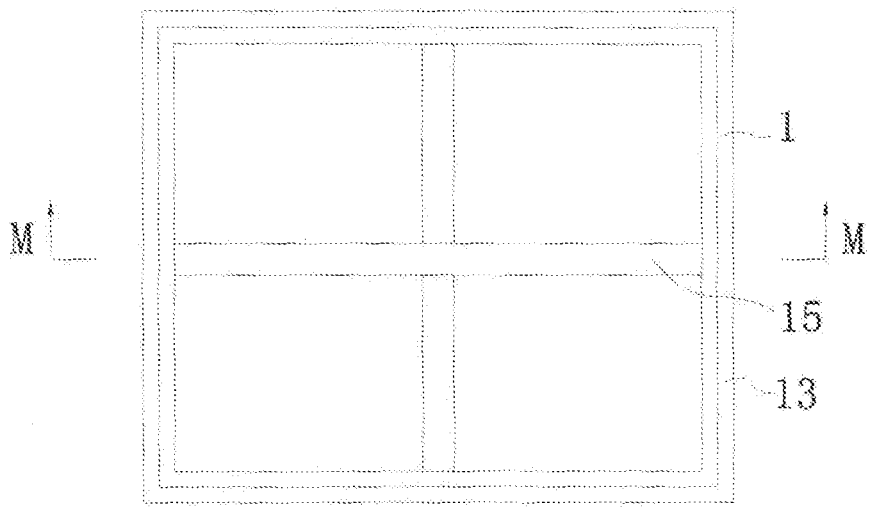
FIG. 1 is a top view of a separation plate in one embodiment of a packaging box of the present invention.
Figure 2:
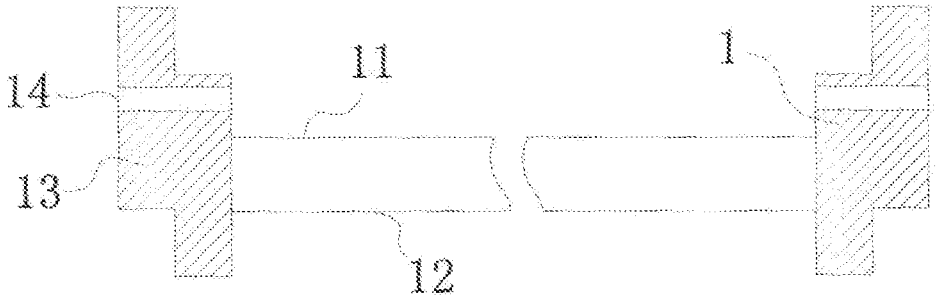
FIG. 2 is a sectional view along line M-M in FIG. 1.
Figure 3:
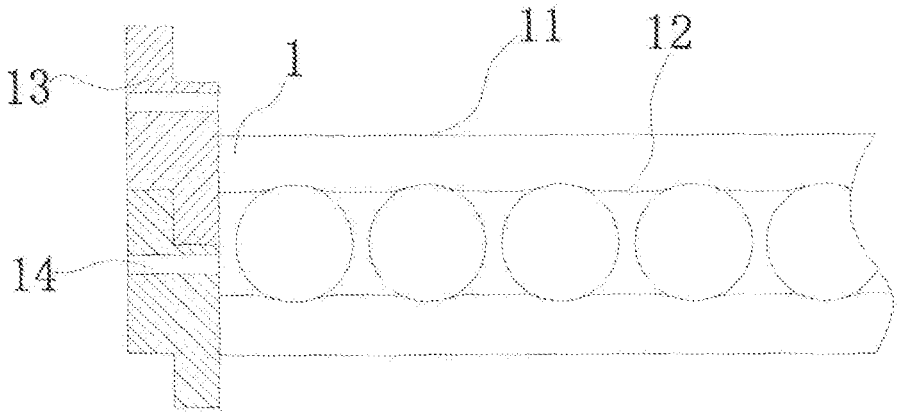
FIG. 3 is a partial schematic view of separation plates which are stacked one above another in one embodiment of a packaging box of the present invention.
Figure 4:
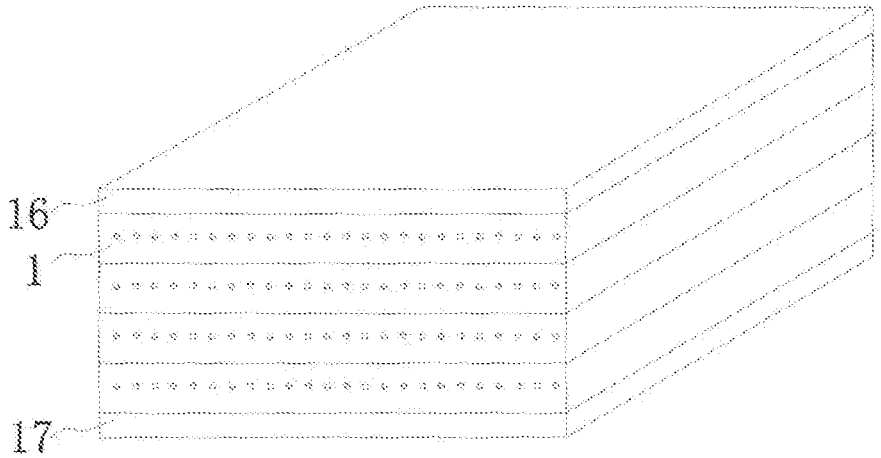
FIG. 4 is a structural schematic view in one embodiment of a packaging box of the present invention.

Hereafter the present invention is further described in detail by means of particular embodiments in conjunction with the drawings.

First Embodiment

Please refer to FIG. 1 to FIG. 4. This embodiment provides a packaging box mainly for packing juicy fruits with a small volume, a soft surface and a low resistance to crushing, for example the package for fruits such as blueberry, cherry, strawberry and waxberry; but the box is also suitable for transporting fruits with a medium size, such as a peach.

A preferable packaging box of the present embodiment is of a cuboid shape, i.e. a cube or a parallelepiped, which can save space in mass transportation. In other embodiments, a packaging box such as a cylinder can also be used, which is applicable to small scale transportation.

The packaging box comprises separation plates 1; when fruits are packaged and transported, the quantity of separation plates 1 is determined according to the practical packaging situation; and the separation plate comprises an upper separation film 11, a lower separation film 12 and a frame 13.

Preferably in this embodiment, the upper separation film 11 and the lower separation film 12 are both made of a cling film material. A cling film not only has a certain elasticity and can bear a certain weight, but also has a certain tensile force to fix the fruits, and is economic and environmentally friendly. In other embodiments, other thin films with a certain elasticity can be used as the upper separation film 11 and the lower separation film 12.

Preferably in the present embodiment, the frame 13 is a frame of a hollow square and fully fixes the peripheral edges of the upper separation film 11 and the lower separation film 12, and the upper separation film 11 and the lower separation film 12 are fixed on the frame 13 by means of adherence with an adhesive, rivet or snapping and the like. A pre-set distance is provided between the upper separation film 11 and the lower separation film 12; the pre-set distance is provided; the pre-set distance should satisfy the condition that in the transportation process, the fruits in the upper layer and in the lower layer will not contact each other when swaying up and down due to shaking. When different fruits are packaged and different materials are used to manufacture the upper separation film 11 and the lower separation film 12, the size of the pre-set distance between the upper separation film 11 and the lower separation film 12 is also different.

The longitudinal section of the frame 13 is an upright Z-shape, and two ends are both provided with a protrusion and a snapping groove for snapping connection; when the frames 13 are stacked one above another, the protrusion of an upper frame 13 is snapped into a snapping groove of a lower frame 13, and at the same time, the protrusion of the lower frame 13 is snapped into a snapping groove of the upper frame 13. A cavity space for accommodating and fixing a fruit is formed between the separation plates 1 which are stacked one above another; the size of the distance between the separation plates 1 is decided according to the fruits to be packaged, the size of the distance between the separation plates 1 should be slightly smaller than the height of the fruit, and the height difference should be set within an elastic range of the cling film. The upper separation film 11 and the lower separation film 12 have a certain elasticity, the fruit is fixed by means of elastic deformation, and an upper end and a lower end of the fruit are wrapped, changing point contact into area contact, thereby improving fixation. The structure of the frame 13 being different and snapping to each other further improves the stability of the frames 13, especially improves the fixing ability against relative parallel displacement of fruits in different layers.

In other embodiments, the frame 13 is composed of an inner frame and an outer frame, the longitudinal sections of the inner frame and outer frame are square, and the inner frame and outer frame are fixed in a staggered manner in the direction of the longitudinal section so as to form the frame 13 of an upright Z-shaped structure. The frame 13 which is constituted directly by the inner frame and outer frame only requires the manufacturing of two identical frames which are fixed in a staggered manner, making the manufacturing convenient and saving the material wasted in the integral processing. It is more economic and environmentally friendly.

Preferably in the present embodiment, a vent 14 for retaining freshness is provided on the frame 13, and the vent can be provided above the upper separation film 11 or below the lower separation film 14, that is to say, the vent is provided on a cavity wall accommodating a fruit. The vent cannot only maintain air venting to enable the fruits to remain freshness, but also enables the cavity to be in communication with the outside, without reducing fixation capability due to decreased elasticity of the upper film and the lower film caused by air retention in jolts.

When the frame 13 is relatively large, the skeleton 15 is provided in the frame; the skeleton 15 passes between the upper separation film 11 and the lower separation film 12, and the skeleton 15 can be provided in a grid shape to support the upper separation film and the lower separation film, thereby improving the supporting capability of the upper separation film and the lower separation film.

In other embodiments, the packaging box also comprises an upper cover 16 and a lower cover 17. After multiple layers of separation plates 1 are stacked one above another, the upper cover 16 and the lower cover 17 are respectively added to the top and bottom of the separation plates 1 to seal and fix two ends of the separation plates, thereby further protecting the fruits and facilitating subsequent packaging.

Figure 9:
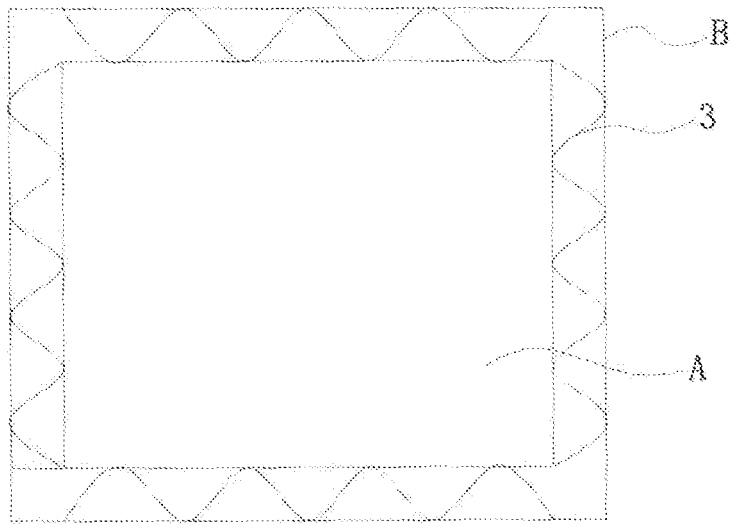
FIG. 9 is a structural schematic view of a wrapped packaging box of the present invention.

Please refer to FIG. 9. In other embodiments, a wave-shaped buffer member 3 is fixed on an outer face of the stacked separation plates 1. When one packaging box A which has plates stacked one above another is transported individually, for example, when a single packaging box A is delivered, six sides of the packaging box are provided with buffer members 3, and then the packaging box is further packaged in a box B, the buffer members 3 offer a buffering effect, thereby improving the safety of the fruits.

In this embodiment, only the upper separation film 11 and the lower separation film 12 are cling films, while the other parts are all manufactured by using recycled paper, which is economic, environmentally friendly, and lightweight.

In this embodiment, during packaging, the lower cover 17 is placed at a bottom end, the fruit is held and fixed layer by layer via the upper and lower separation plates 1, the upper cover 16 is covered, and then ropes are used for further fixation or the packaging box is carried directly. The packaging box facilitates packaging, and the package capacity can be adjusted according to the number of the stacked separation plates 1. Various amount of fruits can be packaged thereby, the packaged fruits are held and fixed by the upper separation film and the lower separation film, the fruits in the same layer are also fixed by elastic deformation of the upper separation film and the lower separation film without rolling and colliding against each other; and at the same time, a pre-set distance is provided between the fruits in adjacent layers, the fruits also would not collide against each other when shaking vertically in the transportation process, thereby improving the safety of fruit transportation. Since the fruits of different layers are packaged separately, even if an individual fruit goes bad, such as bleeding out juice, the fruits on the other layers will not be affected.

Second Embodiment

Figure 5:
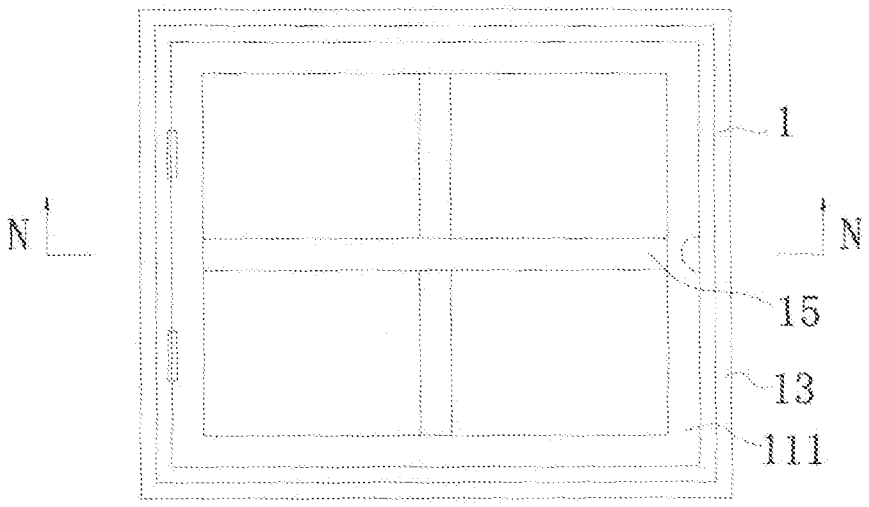
FIG. 5 is a top view of a separation plate in another embodiment of a packaging box of the present invention.
Figure 6:
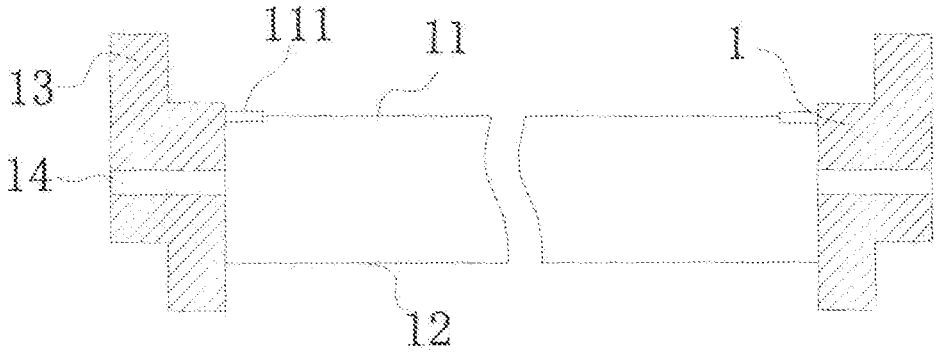
FIG. 6 is a sectional view along line N-N in FIG. 5.
Figure 7:
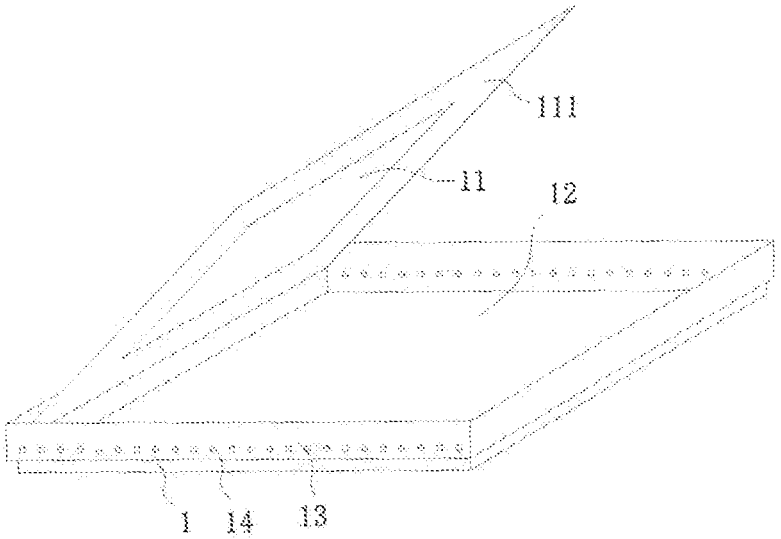
FIG. 7 is a perspective view of a separation plate in another embodiment of a packaging box of the present invention.

Please refer to FIG. 5, FIG. 6 and FIG. 7. This embodiment provides another packaging box, which differs from the packaging box mentioned above in the positions at which the fruits are packaged. In the above-mentioned embodiments, the fruits are held and packaged by two separation plates 1, while in this embodiment, the fruits are packaged by an upper separation film 11 and a lower separation film 12 of the same separation plate 1. The upper separation film 11, the lower separation film 12 and the frame 13 surround a cavity which fixes the fruits, and the height of the cavity is also slightly lower than the height of the fruits.

In order to package the fruits between the upper separation film and the lower separation film of the separation plates 1, a secondary frame 111 is provided on the upper separation film 11, and the secondary frame 111 is in a hinge connection with the frame so that the upper separation film 11 is able to open and close.

Preferably in the present embodiment, an opening end of the secondary frame 111 is provided with an opening part and a fixed part; the opening part is a fixed protrusion or a semicircular notch, which can facilitate opening the secondary frame 111; and the fixed part is a buckle which fixes the closed upper separation film 11, preventing the occurrence of situations affecting the fixation of fruits, such as the situation where the secondary frame 111 is shaken and jumps up.

The size of the distance between the upper separation film 11 and the lower separation film 12 in this embodiment is also determined according to the height of the packaged fruits, the size of the distance is slightly lower than that of the fruits, achieving fixation of the fruits by means of the elastic deformation of the upper separation film 11 and the lower separation film 12. The size of the distance between the separation plates 1 which are stacked one above another is a buffer space, preventing the collision between the fruits in the upper layer and in the lower layer.

The vent 14 of the frame 13 is provided between the upper separation film 11 and the lower separation film 12, that is to say, the vent is provided on a wall of a cavity accommodating the fruits.

When the frame 13 is relatively large, a skeleton 15 is provided, and the skeleton 15 passes above the upper separation film 11 or below the lower separation film 12, that is to say, the skeleton 15 is provided in the buffer space to protect and support the upper separation film and the lower separation film.

In this embodiment, when the packaging box is used to package, the fruits are firstly put into the separation plate 1 with opened upper separation film 11, the upper separation film 11 is then covered and fixed for packaging one layer of fruits, and finally multiple separation plates 1 are fixed together by snapping with frames vertically. The packaging box also packages and fixes fruits via two layers of films, and a certain buffer space is provided between the fruits in the upper layer and in the lower layer. The packaging effect same as that in the above-mentioned embodiments can be achieved.

Third Embodiment

Figure 8:
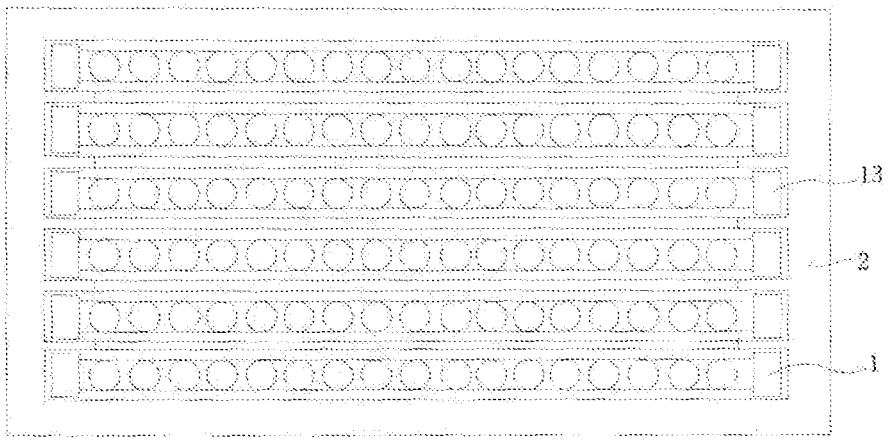
FIG. 8 is a structural schematic view of the separation plates in another embodiment of a packaging box of the present invention.

Please refer to FIG. 8. A box body 2 is added in this embodiment on the basis of the second embodiment, the frame 13 is different from the second embodiment, the frame 13 in this embodiment does not need to be provided with a protrusion and a groove snapping vertically, and the longitudinal section of the frame 13 is square.

The packaging box provided in this embodiment also comprises a box body 2, at least two cavities arranged side by side are provided on the box body 2; preferably, the cavities are vertically arranged cavities like drawers; the cavity is provided with an opening; the cavities are in communication; a protrusion for separating the cavities from each other and for supporting is provided between the cavities; and the distance between the upper cavity and the lower cavity is a buffer area between the fruits in the upper and in the lower layer.

The structure of separation plate 1 is identical to the structure of the separation plate in the second embodiment, both for packaging via the upper separation film 11 and the lower separation film 12, and the upper separation film 11 can be opened and closed.

The box body 2 is added in this embodiment to stack and fix the separation plates 1 in a drawer-like manner, which makes the stack of the separation plates 1 firmer at increased cost.

The contents stated above are further descriptions made for the present invention in conjunction with particular embodiments, and it should not be interpreted that the particular embodiments of the present invention are only limited to these descriptions. For a person of ordinary skill in the art, various simple deductions and replacements can be made without departing from the principle of the present invention.

The invention claimed is:

1. A packaging box for packaging a plurality of objects, comprising:

a plurality of separation plates, wherein the separation plates each include:

an elastic upper separation film, an elastic lower separation film, a frame for supporting the upper separation film and the lower separation film, wherein the upper separation film and the lower separation film are fixed on the frame and spaced apart from each other, wherein a pre-set distance is provided between the upper separation film and the lower separation film, and a skeleton provided on the frame where the skeleton passes between the upper separation film and the lower separation film and has a grid shape extending between opposing sides of the frame;

wherein the plurality of separation plates are stacked one above another via the frames, wherein a plurality of cavities for fixing a respective plurality of objects to be packaged are formed between the upper separation film of each separation plate and the lower separation film of an adjacently stacked separation plate so that the upper separation film of each separation plate and the lower separation film of the adjacently stacked separation plate fix the objects to be packaged in the cavities by elastic deformation, and wherein the pre-set distance provided between the upper separation film and the lower separation film on each separation plate provides a spacing between the plurality of objects to be packaged fixed in the plurality of cavities.

2. The packaging box of claim 1, wherein a vent is provided on the frame and the vent is located either above the upper separation film or below the lower separation film.

3. A packaging box for packaging an object, comprising:

a plurality of separation plates, wherein the separation plates each include:

an elastic upper separation film, an elastic lower separation film, a frame for supporting the upper separation film and the lower separation film and having opposing sides, and a skeleton provided on the frame so that it passes either above the upper separation film or below the lower separation film and has a grid shape extending between opposing sides of the frame, wherein the upper separation film and the lower separation film are fixed on the frame and spaced apart from each other so that a pre-set distance is provided between the upper separation film and the lower separation film;

wherein a secondary frame is provided on the upper separation film of each separation plate and the upper separation film is fixed in a hinge connection on the frame via the secondary frame, so that the upper separation film can be opened and closed while remaining fixed on the frame; and a cavity for fixing an object to be packaged is enclosed by the upper separation film, the lower separation film, and the frame, so that the upper separation film and the lower separation film fix the object to be packaged by elastic deformation.

4. The packaging box of claim 3, wherein a vent is provided on the frame and the vent is located between the upper separation film and the lower separation film.

5. The packaging box of claim 2, wherein the longitudinal section of the frame is an upright Z-shape, and the separation plates are snapped together via the Z-shaped structure of the frame such that the separation plates are stacked.

6. The packaging box of claim 5, wherein the frame is composed of an inner frame and an outer frame having square longitudinal sections, the inner and outer frames are fixed in a staggered manner in the direction of the longitudinal section to form the frame of an upright Z-shaped structure.

7. The packaging box of claim 6, further comprising an upper cover and a lower cover and the upper cover and the lower cover are respectfully fixed at upper and lower ends of the separation plates which are stacked.

8. The packaging box of claim 7, further comprising a wave-shaped buffer member, the buffer member being fixed on an outer surface of the separation plates which are stacked.

9. The packaging box of claim 3, further comprising a box body, the box body being provided with at least two cavities for accommodating the separation plates, a space for separating the separation plates is provided between the cavities, and the separation plates are fixed in the cavities of the box body.

* * * * *